US007014162B2

(12) United States Patent
Lion et al.

(10) Patent No.: US 7,014,162 B2
(45) Date of Patent: Mar. 21, 2006

(54) ICE CUBE TRAY WITH SERVER COVER

(75) Inventors: Mathieu Lion, Paris (FR); Lucas Bignon, Cachan (FR)

(73) Assignee: Mastrad S.A., Paris (FR)

( * ) Notice: Subject to any disclaimer, the term of this patent is extended or adjusted under 35 U.S.C. 154(b) by 0 days.

(21) Appl. No.: 10/754,757

(22) Filed: Jan. 9, 2004

(65) Prior Publication Data

US 2005/0151049 A1 Jul. 14, 2005

(51) Int. Cl.
*F25C 1/24* (2006.01)

(52) U.S. Cl. ..... 249/121; 249/126; 249/127; D15/90

(58) Field of Classification Search ..... 249/119, 249/121, 126, 127; 426/515; 49/463; 220/797, 220/806; D15/90
See application file for complete search history.

(56) References Cited

U.S. PATENT DOCUMENTS

| | | | | | |
|---|---|---|---|---|---|
| 1,688,888 | A | * | 10/1928 | Spreen | D15/90 |
| 1,755,795 | A | * | 4/1930 | Rhodes | 249/127 |
| 1,896,849 | A | | 2/1933 | Newman | |
| 1,953,167 | A | * | 4/1934 | Geyer | 249/127 |
| 2,053,711 | A | * | 9/1936 | Glomb | 249/127 |
| 2,182,454 | A | | 12/1939 | Sherman | |
| D137,122 | S | | 1/1944 | Gits | |
| 2,340,675 | A | * | 2/1944 | Mallard | D15/90 |
| 2,389,317 | A | * | 11/1945 | Kitto | 249/127 |
| 2,404,973 | A | * | 7/1946 | Mallard | D15/90 |
| 2,497,743 | A | * | 2/1950 | Roethel | 249/127 |
| 2,584,838 | A | * | 2/1952 | Boyle | D15/90 |
| 2,932,386 | A | * | 4/1960 | Ushkow | 249/127 |
| D190,839 | S | | 7/1961 | Voigtmann | |
| D200,558 | S | | 3/1965 | Davis | |
| 3,214,128 | A | | 10/1965 | Beck | |
| 3,306,567 | A | * | 2/1967 | Frei, Sr. | 249/127 |
| 3,374,982 | A | | 3/1968 | Sallade | |
| 3,414,229 | A | * | 12/1968 | Norberg | 249/121 |
| 3,480,251 | A | * | 11/1969 | Pietrzak | 249/127 |
| 3,483,908 | A | * | 12/1969 | Donovan | 249/127 |
| 3,696,635 | A | * | 10/1972 | Fogt | D15/90 |
| 3,724,804 | A | * | 4/1973 | Campbell | D15/90 |
| 3,776,504 | A | | 12/1973 | Wiley | |
| 3,829,056 | A | * | 8/1974 | Baker et al. | 249/121 |
| 3,844,525 | A | | 10/1974 | Parmett | |
| 4,081,122 | A | | 3/1978 | Hobson | |
| 4,222,547 | A | * | 9/1980 | Lalonde | 249/127 |

(Continued)

FOREIGN PATENT DOCUMENTS

| | | |
|---|---|---|
| DE | 19922439 | 11/1998 |

(Continued)

*Primary Examiner*—James P. Mackey
(74) *Attorney, Agent, or Firm*—Mark Montague; Cowan Liebowitz & Latman, P.C.

(57) ABSTRACT

An ice cube tray having a rigid support structure for easy handling and manipulation includes plural ice cube compartments, the ice cube compartments including deformable, flexible bottoms to enable ejection of ice cubes by application of a small force on each ice cube compartment's bottom. The tray may be used with a cover that can be utilized as a server. The tray when used with the cover is spill proof. To use as a server, the tray and cover are turned upside down, the ice cubes are ejected by applying force to the flexible bottoms of the ice cube compartments. Once ejected, the tray is removed to reveal the ejected ice cubes within the underside of the cover. Multiple ice cube trays can be stacked on top of the cover.

21 Claims, 4 Drawing Sheets

U.S. PATENT DOCUMENTS

| | | | | | |
|---|---|---|---|---|---|
| 4,272,049 | A | * | 6/1981 | Kindel | 249/127 |
| 4,286,713 | A | * | 9/1981 | Marchais | 220/800 |
| D263,398 | S | * | 3/1982 | Tiller | D15/90 |
| 4,432,529 | A | | 2/1984 | McMillan | |
| 4,787,527 | A | * | 11/1988 | Monetti | 220/801 |
| 4,883,251 | A | * | 11/1989 | Manas | 249/157 |
| D309,905 | S | | 8/1990 | Weissman | |
| 4,967,995 | A | * | 11/1990 | Burgess | 249/127 |
| D320,994 | S | | 10/1991 | Kafka et al. | |
| 5,196,127 | A | | 3/1993 | Solell | |
| D352,045 | S | * | 11/1994 | Daenen et al. | D15/90 |
| 5,393,032 | A | * | 2/1995 | Cederroth | 249/127 |
| 5,397,097 | A | | 3/1995 | Dale | |
| D359,966 | S | * | 7/1995 | Laib et al. | D15/90 |
| D415,505 | S | * | 10/1999 | Myers | D15/90 |
| 6,168,131 | B1 | | 1/2001 | Tabatabaie | |
| 6,196,518 | B1 | | 3/2001 | Garrido-Lecca | |
| 6,371,364 | B1 | * | 4/2002 | Maillot et al. | 220/796 |
| D496,374 | S | | 9/2004 | Zimmerman | |

FOREIGN PATENT DOCUMENTS

| | | | |
|---|---|---|---|
| DE | 101 35 206 | * | 2/2002 |
| FR | 2306412 | * | 10/1976 |
| FR | 2437 590 | | 12/1978 |
| GB | 2267957 | | 12/1993 |
| JP | 2003-185311 | * | 7/2003 |
| WO | WO91/14909 | * | 10/1991 |

* cited by examiner

ICE CUBE TRAY WITH SERVER COVER

FIELD OF THE INVENTION

The present invention relates to an ice cube tray and, more particularly, to an ice cube tray having a rigid support structure for easy manipulation and handling along with a server cover that contain novel features to enable easy ejection of ice cubes formed therein and manner of serving.

BACKGROUND OF THE INVENTION

Ice cube trays are well known in the art and generally are sold in a variety of shapes and sizes. Similarly, ice cube tray covers are known. A variety of designs have been provided that enable the user to eject ice cubes from the trays. Various designs are disclosed in the following patents and published applications: U.S. Pat. Nos. 1,896,849; 2,182,454; 3,214,128; 3,374,982; 3,776,504; 3,844,525; 4,432,529; 5,196,127; 5,397,097; U.S. Des. 309,905; U.S. Des. 320,994; GB 2267957; and DE 19922439. Many additional designs certainly exist.

While many designs for ice cube trays have been previously proposed, additional variations and improvements can still be made to improve upon the art.

OBJECTS AND SUMMARY OF THE INVENTION

It is therefore an object of the present invention to provide an improved ice cube tray. It is a particular object to provide an ice cube tray that employs a novel feature to enable the easy and efficient ejection of ice cubes from the tray. It is a further object to provide a novel cover that is useful beyond being just a cover for the tray.

These objects are attained by an ice cube tray having plural ice cube compartments, with each ice cube compartment defined by a respective side wall and bottom surface. In accordance with the invention, the bottom surfaces of the ice cube compartments are made of a deformable flexible material. Then, to eject an ice cube from an ice cube compartment, a small amount of force is exerted upon the underside of the compartment.

As a feature, the ice cube tray has a generally rigid support structure and includes a water retaining surface that includes an inner retaining surface made from the deformable flexible material which retains the side walls of a cover that is placed on the ice cube tray.

As another feature, a cover is especially designed for use with the ice cube tray and serves to minimize water spillage and introduction of odors and particles into the ice cube compartments during use. The cover also can be utilized to serve ice cubes ejected from the ice cube tray. The cover can include a support structure that enables stacking of multiple sets of ice cube trays, and the cover can include a base design that slows down the melting of ice cubes contained with the cover while it is being used as a server.

Various other objects, advantages and features of the present invention will become readily apparent to those of ordinary skill in the art, and the novel features will be particularly pointed out in the appended claims.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE INVENTION

Figure 1:
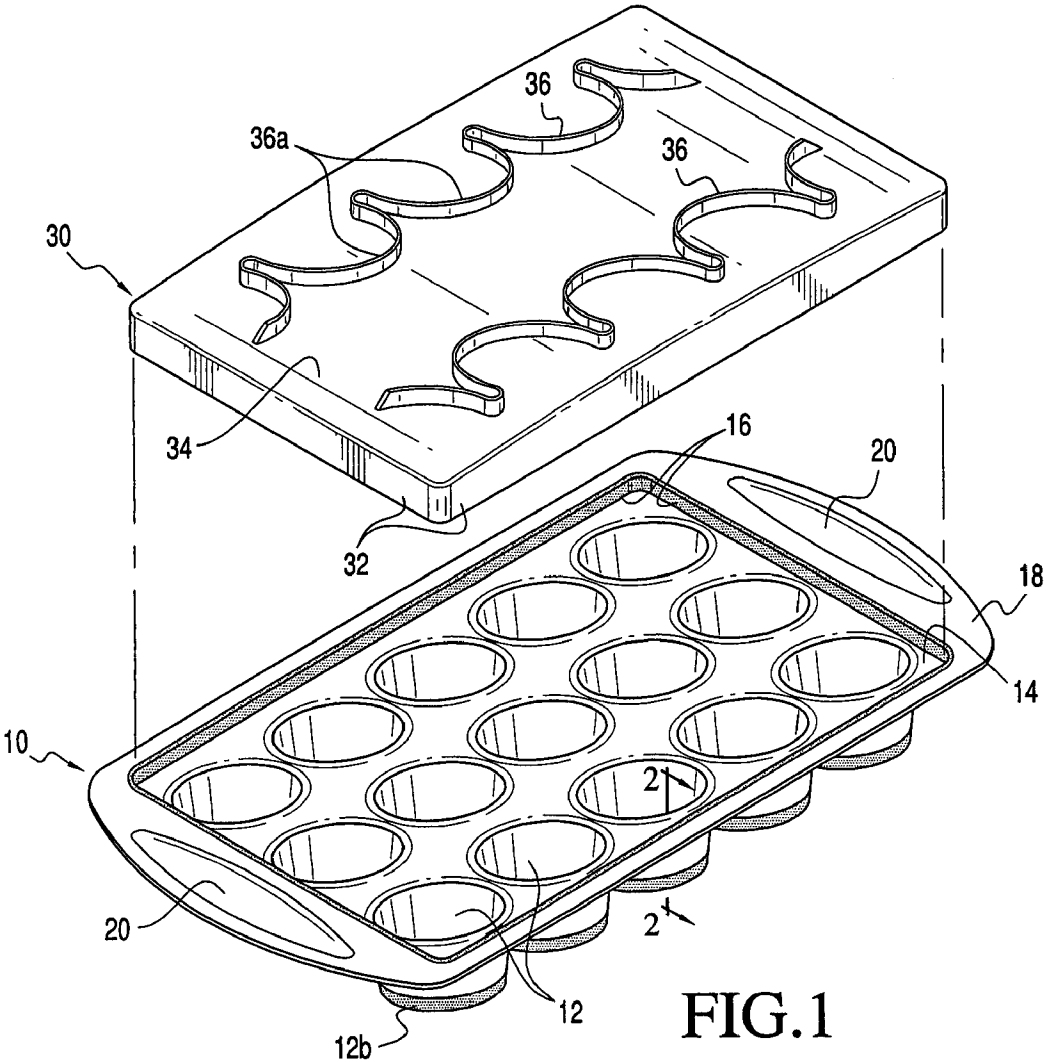
FIG. 1 schematically illustrates the ice cube tray and cover of the present invention.

The present invention pertains to a novel ice cube tray and also to a novel cover. The combination ice cube tray and cover is shown in FIG. 1 of the drawings. As shown, the combination includes an ice cube tray 10 and a cover 30. As will be appreciated, the ice cube tray 10 may be used with or without cover 30, and particular novel features of each are discussed below. For purposes herein, the term "cube" (such as used in "ice cube," "ice cube compartment," "ice cube tray," etc.) is used for convenience to refer to any appropriate three-dimensional shape, not just a geometrically defined cube.

Referring first to ice cube tray 10 (or "tray 10") shown in FIG. 1, tray 10 includes a plural number of ice cube compartments 12, each for forming from water a respective ice cube. In the exemplary design shown in the drawings, tray 10 includes fifteen oval-shaped compartments. Of course, the tray may contain a different number of compartments and be different in shape, and the shape of each ice cube compartment may be different than that shown. Tray 10 further includes a compartment surface 14 in which each of the ice cube compartments 12 is disposed. A water retaining surface 16 extends vertically from each of the four ends of compartment surface 14 and operates as a vertical retaining wall to retain any water within the compartments during filling, as further discussed below. Water retaining surface 16 also operates to grip cover 30, as also further discussed below. Water retaining surface extends vertically to the top surface, or gripping surface 18, of the ice cube tray. Gripping surface 18 extends around tray 10 and includes two sets of grips 20 at the long ends of tray 10, as shown in FIG. 1.

Figure 2:
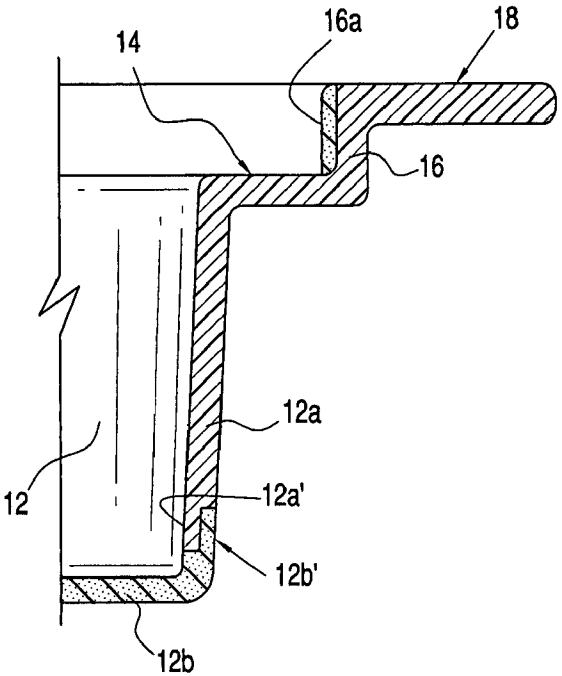
FIG. 2 shows a portion of an ice cube compartment within the tray taken along the line 2—2 shown in FIG. 1.

In accordance with the present invention, ice cube tray 10 includes on various surfaces a deformable and flexible material, and preferably an elastic material. In particular, the elastic material preferably is Thermo Plastic Rubber (TPR) or Silicone or natural rubber. With reference to FIG. 2, which is a schematic illustration showing a portion of one of the ice cube compartments 12 within tray 10 taken along the line 2—2 shown in FIG. 1, each compartment 12 includes a rounded side wall (or surface) 12*a* and a mostly flat bottom surface 12*b*. In accordance with the present invention, side wall 12*a* is made of a suitably firm material, such as hard plastic or even metal, and bottom surface 12*b* is made of the above-mentioned deformable and flexible material, such as silicone, TPR or natural rubber. In a preferred embodiment of the present invention, side wall 12*a* and bottom surface 12*b* interconnect as shown in FIG. 2, wherein side wall 12*a* includes a narrower portion 12*a*' to allow the flexible material of bottom wall 12*b* to overlap it (represented by 12*b*' in the figure). With narrower portions 12*a*' and 12*b*' as shown in FIG. 2, the outer surface of each ice cube compartment 12 is smooth (i.e., no substantial bump) along the transition from rigid side surface 12*a* to flexible bottom surface 12*b*. Although not preferred, it is possible that less than all of the bottom surfaces 12*b* are made of the flexible material.

FIG. 2 further shows the horizontal compartment surface 14 (located at the top of the ice cube compartments 12), vertical water retaining surface 16 and gripping surface 18. Preferably, compartment surface 14 is made of a rigid material, such as hard plastic, thus providing the ice cube tray of the present invention with a rigid support structure. Referring back to FIG. 1, water retaining surface 16 and gripping surface 18 extend fully around tray 10. In accordance with the present invention, and as shown in FIG. 2, an inner retaining surface 16*a* that is made of the above-mentioned deformable, flexible material is provided adjacent to the interior of retaining surface 16, along the entire length of this surface (represented by the shaded portion of surface 16 shown in FIG. 1). As further discussed below, inner surface 16*a* operates to appropriately retain cover 30 during use of the present invention.

Figure 3:
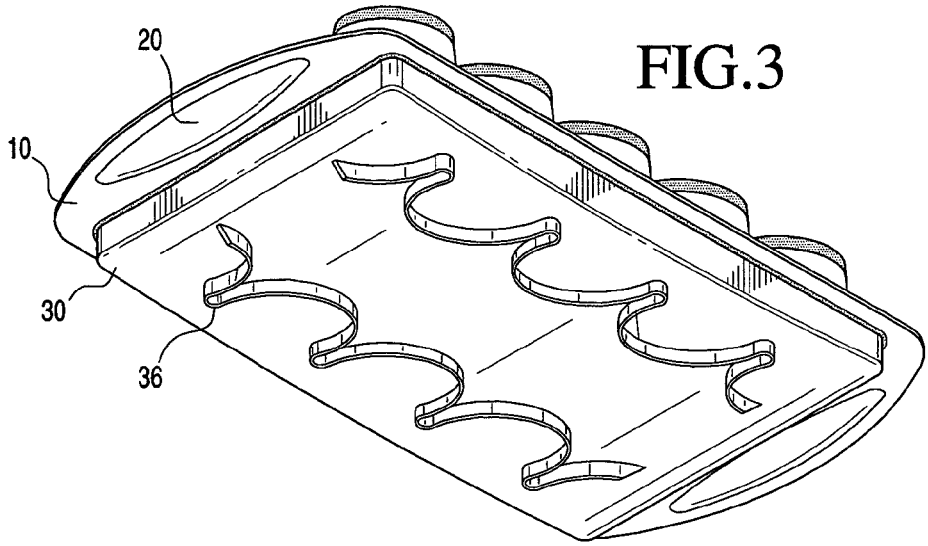
FIG. 3 is a schematic illustration of the ice cube tray in use with the cover in accordance with the present invention.
Figure 4:
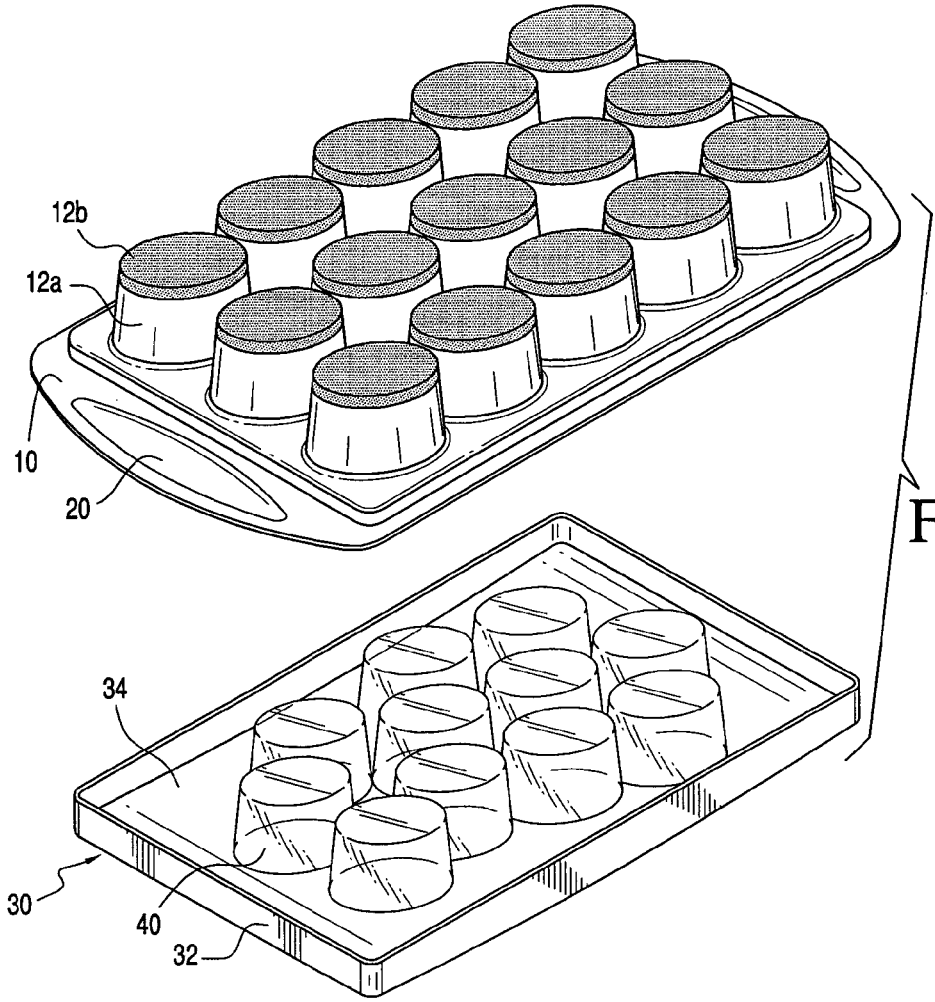
FIG. 4 is a schematic illustration of the use of the cover as a server of ice ejected from the ice cube tray in accordance with the present invention.
Figure 5:
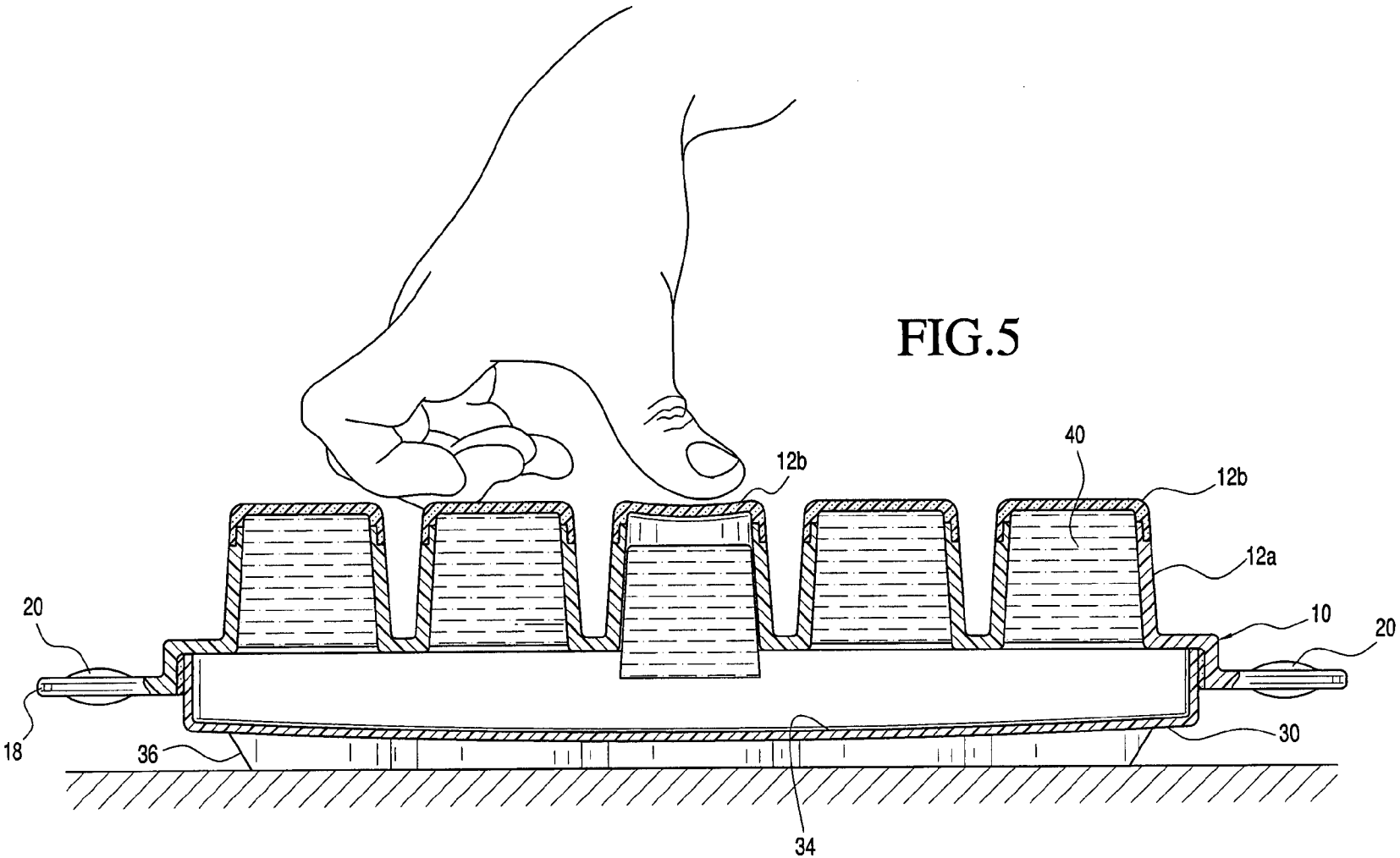
FIG. 5 is a schematic illustration of how an ice cube may be ejected from the ice cube tray in accordance with the present invention.
Figure 6:
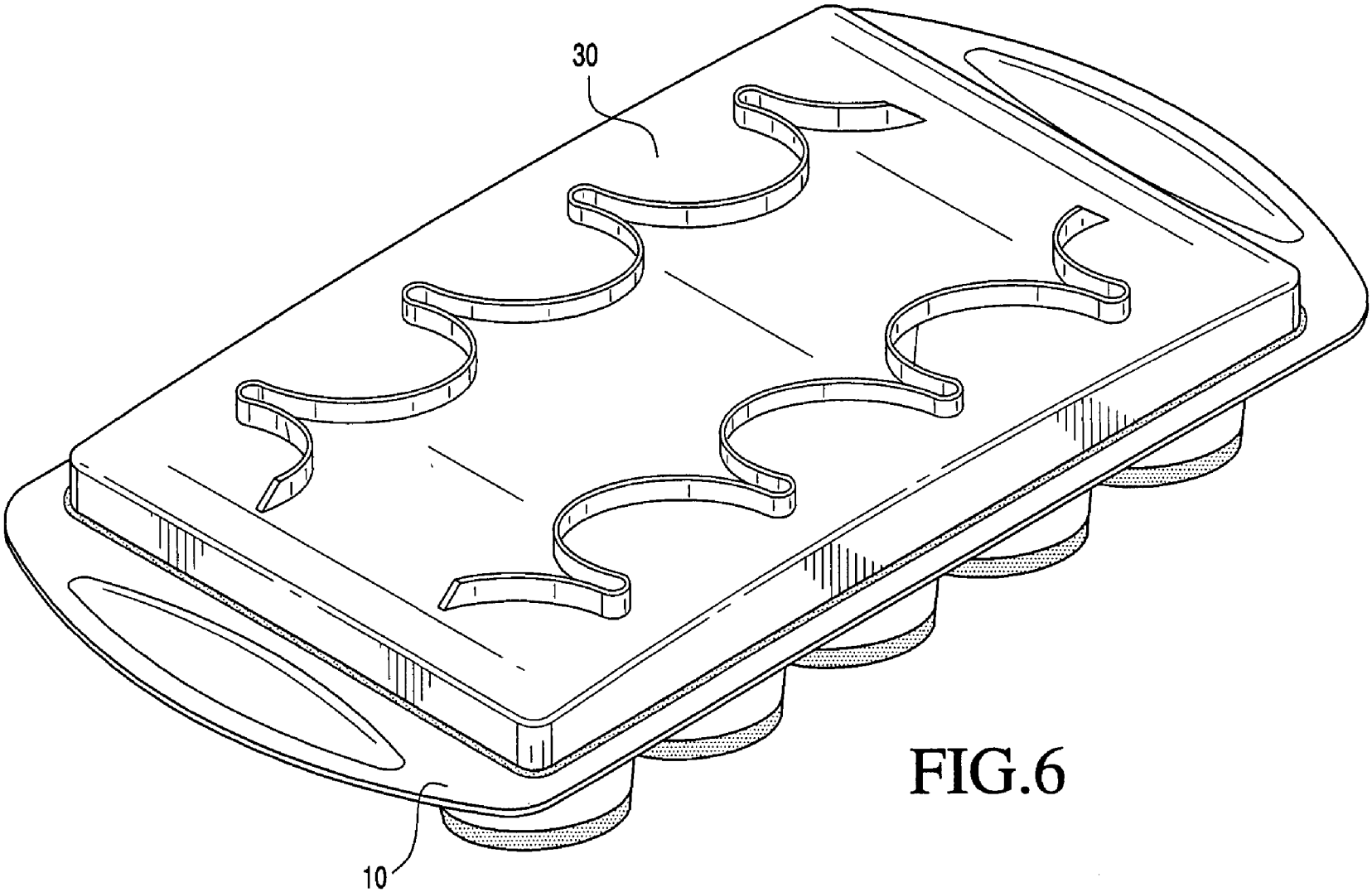
FIG. 6 shows the combination ice cube tray with cover of the present invention.

Referring again to FIG. 1, as well as to FIGS. 3 and 4, cover 30 includes a set of side walls 32, a base 34, and two sets of supports 36. Side walls 32 extend from base 34 and are appropriately sized and positioned so that cover 30 can be placed into the space defined by water retaining surface 16, as shown in FIG. 6 (as well as in FIGS. 3 and 5). In accordance with the present invention, inner retaining surface 16*a*, disposed adjacent to retaining surface 16, due to its flexible nature sufficiently holds cover 30 when inserted. Thus, inner retaining surface 16*a* serves to retain cover 30 which in turn provides for improved water retention against spilling of water while carrying the ice cube tray during use, as further discussed below. In addition, the relatively tight connection of cover 30 to the top of the ice cube tray advantageously prevents or at least minimizes the introduction of gasses, odors and small particles into the ice cube compartments 12. This is highly desirable since gasses and odors adversely cause ice cubes that are formed to contain an undesirable smell or other form of contamination. Moreover, since surface 16*a* is made of a flexible, deformable material, cover 30 also is easily lifted away from tray 10 during use.

Cover 30 includes two sets of supports 36. Supports 36 serve multiple purposes, in accordance with the present invention. First, supports 36 allow cover 30 to be used as a so-called server, as shown in FIG. 4. In particular, cover 30 can be used upside-down and placed on a surface such as a table. Ice cubes ejected from tray 10 (or other items) can be placed on (the underside of) base 34 with the four side walls 32 serving to retain what is placed on the base and, further, supports 36 support the base on the table. Although base 34 can rest on a tabletop surface without supports 36, it is generally advantageous to include supports 36 for both aesthetic and functional purposes, as would be appreciated by those using the tray and cover of the present invention. Since the cover is intended to be used as a server for ice ejected from the tray of the present invention, the cover will tend to get cold during such serving, which may result in water condensation along the surfaces of the cover. The use of supports 36 prevents, or at least minimizes, water condensation from touching the table top. In addition to minimizing accumulation of water on the table, such enables the easy lifting of the cover from that table upon completion of use of the cover as a server. If base 34 directly contacted, for example, a wooden table then water condensation would cause at least slight difficulty in lifting the cover away from the table, an undesirable characteristic of a server. Supports 36 thus are an advantageous feature of cover 30.

In addition, the particular shape of each support 36 allows for the stacking of multiple sets of trays/covers of the present invention. As shown in FIG. 1, each support 36 includes plural curved portions 36*a* (also called sections 36*a*). Each curved portion 36*a* has the same curvature as the bottom of each ice cube compartment 12. By providing two sets of supports 36 as shown in FIG. 1, with each support having its respective curved portions 36*a* extending in directions opposite to one another (that is, the curves of each support extends towards the middle of the cover), the bottom of tray 10 may be placed on and sufficiently retained by cover 30. Once placed on cover 30, tray 10 is retained and cannot slide on the cover in any longitudinal (i.e., sideways) direction. Thus, a combination tray/cover of the present invention, such as shown in FIG. 6, may be place on and sufficiently retained by a second combination tray/cover of the present invention. Additional tray/cover combinations may still further be stacked so that 2, 3 or more sets of tray/cover combinations may be easily carried and stored without risk that any tray will slide off a cover that is disposed below it. Still further, since the bottom surface 12*b* of each ice cube compartment 12 is made of the above-mentioned flexible material, such as silicone, proper stacking of tray/cover combinations is further facilitated due to the retaining characteristics of such flexible material. In comparison to the stacking of fully hard plastic trays/covers on top of one another, the particular material of bottom surface 12*b* of each ice compartment, along with the particular design of supports 36, provides superior stacking capability.

In addition to the above-described stacking feature of the present invention, since each curved section 36*a* has the same shape, the trays and covers of the present invention may be stacked in an offset manner. For example, the ice cube compartments 12 adjacent to one of the grips 20 (e.g., the left-most compartments) may be placed within the curved portions 36*a* located in the central portion of cover 30. Thus, stacking of multiple tray/cover combinations is possible also horizontally, in addition to vertically. For example, multiple ice cube trays and covers of the present invention may be stacked in a pyramid-style manner.

The ice cube tray 10 of the present invention is initially filled with water in a manner that is well known in the art. In particular, tray 10 is placed under a water faucet (or other source of water) and filled so that each ice cube compartment 12 is substantially filled with water. Other liquids may be used, such as orange juice, etc. Ice cube tray 10 may be placed in a freezer of some sort with or without cover 30. Preferably, cover 30 is utilized to minimize spillage of water during transport of tray 10 to the freezer, as well as prevent or at least minimize the introduction of gasses or odors (or other small particles) into the ice cube compartments. Then, within an appropriate freezer, water within each ice cube compartment 12 freezes, turning into ice cubes.

Once frozen, each ice cube may be dispensed (ejected), in accordance with the present invention, by applying force against the bottom of one or more of the ice cube compartments 12. Such as shown in FIG. 5, a user's thumb can easily supply sufficient force upon the flexible bottom surface 12*b* of one of the ice cube compartments to forcibly eject an ice cube 40. Multiple ice cubes can be ejected simultaneously by the use of two thumbs (or other fingers from one or both hands). Other means for applying force can also be utilized. If cover 30 is utilized, then the combination tray/cover can be turned upside down (FIG. 3) and placed on a table or other surface of some sort, and then each ice cube 40 can be ejected in the manner just described. Ice cubes can also be ejected while tray 10, with or without cover 30, is held in the air. If desired, only a single ice cube can be ejected, or multiple ice cubes can be ejected. Unlike most if not all prior art designs, an exact number of ice cubes can be ejected, whether one, some or all of the ice cubes formed in the ice cube tray of the present invention. Further, selected ice cubes can be ejected, a difficult feat in most prior art designs. If tray 30 is utilized during ejection of the ice cubes, then once ejected, tray 10 can be lifted away from cover 30, such as shown in FIG. 4, thus providing the ejected ice cubes in an appropriate server (i.e., cover 30).

In the preferred embodiment, base 34 of cover 30 slightly slopes inward, towards its center (with supports 36 sized accordingly), as shown in FIG. 5. With such sloping of base 34, all of the ice cubes within the cover, while it is being used as a server, stay in the center of the cover, such as shown in FIG. 4, an aesthetically pleasing characteristic. Moreover, the inward slope of cover 30 advantageously slows the melting of the ice cubes as compared to a flat, non-sloped base. In a particularly preferred version of the cover of the present invention, cover 30, when used as a server, has sufficient inner volume to retain all the water that results from the complete melting of all of the ice cubes. Thus, the server advantageously cannot overflow during normal use of the ice cube tray and cover of the present invention.

Referring again to each of the figures, tray 10 includes two grips 20 disposed at two ends of gripping surface 18. Preferably, grips 20 are made of the above-described deformable and flexible material, such as silicone, to provide enhanced and aesthetically pleasing grips.

While the present invention has been particularly shown and described in conjunction with a preferred embodiment thereof, it will be readily appreciated by those of ordinary skill in the art that various changes may be made without departing from the spirit and scope of the invention. For example, the particular number, size and shape of each ice cube compartment 12 may be different than that shown and discussed. In addition, the size and shape of respective ice cube compartments may be different to provide varied-shaped/sized ice cubes.

Therefore, it is intended that the appended claims be interpreted as including the embodiments described herein, the alternatives mentioned above, and all equivalents thereto.

What is claimed is:

1. An ice cube tray, comprising:

a plurality of ice cube compartments, each of the ice cube compartments being defined by a side wall and a bottom surface, the entire bottom surface of at least one of the ice cube compartments being made of a deformable, flexible and substantially elastic material and the side wall of said at least one of the ice cube compartments being made at least partially of a rigid material and partially of the deformable, flexible and substantially elastic material; and a compartment surface, each of the plurality of ice cube compartments extending from the compartment surface.

2. The ice cube tray of claim 1, wherein the entire bottom surface of all of the ice cube compartments are made of the deformable flexible material and the side walls of all of the ice cube compartments being made at least partially of the deformable, flexible and substantially elastic material.

3. The ice cube tray of claim 1, wherein the deformable flexible material is adapted to enable ejection of an ice cube formed within the respective ice cube compartment by exerting a force upon the bottom surface made of the deformable flexible material, and the compartment surface is made of a rigid material to enable manipulation and handling of the ice cube tray during ejection of the ice cube.

4. The ice cube tray of claim 1, further comprising a water retaining surface extending from an outside of the compartment surface and adapted to retain a liquid disposed on the compartment surface.

5. The ice cube tray of claim 4, wherein the water retaining surface further is adapted to retain side walls of a cover placed on the ice cube tray.

6. An ice cube tray comprising:

a plurality of ice cube compartments, each of the ice cube compartments being defined by a side wall and a bottom surface, the bottom surface of at least one of the ice cube compartments being made of a deformable flexible material and the side wall of said at least one of the ice cube compartments being made at least partially of a rigid material;

a compartment surface, each of the plurality of ice cube compartments extending from the compartment surface;

a water retaining surface extending from an outside of the compartment surface and adapted to retain a liquid disposed on the compartment surface; and an inner retaining surface made of the deformable flexible material disposed along an interior of the water retaining surface and adapted to releasably retain side walls of a cover placed on the ice cube tray.

7. The ice cube tray of claim 1, wherein, for each of said at least one of the ice cube compartments being made of a deformable flexible material, the side wall includes a rigid narrow portion disposed at a lower end of the compartment and the bottom surface, being made of said deformable, flexible and substantially elastic material, extends over the rigid narrow portion of the side wall.

8. The ice cube tray of claim 7, wherein the bottom surface extends over the rigid narrow portion of the side wall in such manner so that a transition from the bottom surface made of the deformable flexible material to the side wall is smooth.

9. The ice cube tray of claim 1, wherein the deformable flexible material is Thermo Plastic Rubber (TPR), Silicone or natural rubber.

10. An ice cube tray comprising:

a plurality of ice cube compartments, each of the ice cube compartments being defined by a side wall and a bottom surface;

a compartment surface, each of the plurality of ice cube compartments extending from the compartment surface;

a water retaining surface extending from an outside of the compartment surface and adapted to retain a liquid disposed on the compartment surface, and further adapted to retain side walls of a cover placed on the ice cube tray; and an inner retaining surface made of a deformable flexible material disposed along an interior of the water retaining surface and adapted to releasably retain side walls of a cover placed on the ice cube tray.

11. A combination ice cube tray and cover, comprising:

an ice cube tray having a plurality of ice cube compartments and a retaining surface extending from outer ends of the ice cube tray;

a cover having a base and side walls, the cover being adapted to be placed on top of the ice cube tray and the retaining surface of the ice cube tray being adapted to releasably retain the side walls of the cover;

the retaining surface including an inner portion made of a deformable flexible material, and the inner portion is adapted to releasably retain the side walls of the cover.

12. The combination ice cube tray and cover of claim 11, wherein a connection between the cover and the ice cube tray is sufficiently tight so as to prevent introduction of exterior gasses, odors and particles from entering into the ice cube compartments, and also sufficiently tight to prevent substantial spillage of liquid contained within the ice cube tray.

13. The combination ice cube tray and cover of claim 11, wherein the cover includes a support extending from the base of the cover, the support having a shape adapted to retain an ice cube tray to allow stacking of the ice cube tray on top of the cover.

14. The combination ice cube tray and cover of claim 13, wherein a bottom surface of at least one of the ice cube compartments is made of a deformable flexible material; and the support of the cover is adapted to sufficiently retain with limited longitudinal movement bottom surfaces of the ice cube tray when the ice cube tray is stacked on top of the cover.

15. The combination ice cube tray and cover of claim 11, wherein the cover includes a first support having a shape that matches a shape of a bottom of at least one of the ice cube compartments, and the cover includes a second support having said shape, and the first and second supports are positioned on the cover to enable stacking of an ice cube tray having ice cube compartments disposed on top of the cover.

16. The combination ice cube tray and cover of claim 15, wherein the first and second supports have shapes that are opposite in direction to one another so that an ice cube tray can be stacked on top of the cover without any significant longitudinal movement.

17. The combination ice cube tray and cover of claim 11, wherein the base and side walls of the cover have sufficient dimensions so that a volume of liquid that can be retained by the base and side walls of the cover is greater than a volume of liquid that can be retained by all of the ice cube compartments of the ice cube tray so that the cover does not overflow with liquid or ice originally stored within the ice cube compartments of the ice cube tray.

18. A combination, comprising:

the ice cube tray recited in claim 1; and a cover for the ice cube tray, comprising:

a base;

a set of side walls extending from an outer perimeter of the base; and a support extending from the base in a direction opposite to a direction from which the side walls extend from the base, the support including first and second supports, each of the first and second supports having a curved shape that match and follow shapes of curved bottoms of ice cube compartments of an ice cube tray so that the cover is adapted to retain the ice cube tray to allow stacking;

the side walls being adapted to be releasably retained by an ice cube tray, and the support being adapted to support the base of the cover for use as a server when the cover is not retained by the ice cube tray.

19. The combination of claim 18, wherein the first and second supports of the cover have shapes that are opposite in direction to one another so that the ice cube tray can be stacked on top of the cover without any substantial longitudinal movement.

20. The combination of claim 18, wherein the base of the cover has an inward slope so that liquid or ice stored within the base has a tendency to travel toward a center of the base.

21. The combination of claim 20, wherein the base of the cover has an inward slope adapted to reduce melting of ice stored within the base as compared to a base without an inward slope.

* * * * *